US011691191B2

(12) United States Patent
Rusch

(10) Patent No.: US 11,691,191 B2
(45) Date of Patent: Jul. 4, 2023

(54) ROLL BENDER WITH WORK PIECE SUPPORT

(71) Applicant: JPW Industries Inc., Lavergne, TN (US)

(72) Inventor: Christopher J. Rusch, Sturgeon Bay, WI (US)

( * ) Notice: Subject to any disclaimer, the term of this patent is extended or adjusted under 35 U.S.C. 154(b) by 1 day.

(21) Appl. No.: 17/402,197

(22) Filed: Aug. 13, 2021

(65) Prior Publication Data

US 2022/0048085 A1 Feb. 17, 2022

Related U.S. Application Data

(60) Provisional application No. 63/065,172, filed on Aug. 13, 2020.

(51) Int. Cl.

| | |
|---|---|
| ***B21B 13/04*** | (2006.01) |
| ***B21B 13/14*** | (2006.01) |
| ***B21B 1/09*** | (2006.01) |

(52) U.S. Cl.

CPC ..... *B21B 13/04* (2013.01); *B21B 1/09* (2013.01); *B21B 13/14* (2013.01); *B21B 2269/16* (2013.01)

(58) Field of Classification Search

CPC B21B 1/09; B21B 13/04; B21B 13/14; B21B 2269/16; B21B 7/08; B21B 5/14

See application file for complete search history.

(56) References Cited

U.S. PATENT DOCUMENTS 4,080,815 A * 3/1978 Foster ..... B21D 7/08 72/65
4,117,702 A * 10/1978 Foster ..... B21D 7/08 72/173
5,187,959 A * 2/1993 Davi ..... B21D 5/14 72/173
2004/0237619 A1* 12/2004 Caporusso ..... B21D 7/08 72/171
2015/0224554 A1 8/2015 Meliga

FOREIGN PATENT DOCUMENTS

| | | | |
|---|---|---|---|
| CN | 205763153 | U | 12/2016 |
| JP | H08117873 | A | 5/1996 |
| KR | 19980019949 | A | 6/1998 |
| KR | 101644012 | B1 | 7/2016 |

OTHER PUBLICATIONS

PCT Application No. PCT/US2021/045991, International Search Report and Written Opinion dated Dec. 8, 2021.

* cited by examiner

*Primary Examiner* — Teresa M Ekiert
(74) *Attorney, Agent, or Firm* — Bradley Arant Boult Cummings, LLP; Blake Bernard

(57) ABSTRACT

A roll bender apparatus is disclosed for bending a work piece, the apparatus including a base, a bending roller rotatably disposed on the base, a first guide roller rotatably disposed on base. and a second guide roller rotatably disposed on the base. A first work piece guide assembly is movable about the first guide roller and a second work piece guide assembly movable about the second guide roller. The first and second work piece guide assemblies are oriented to receive the work piece, and the first and second work piece guide assemblies are configured to move about the first and second guide rollers respectively in response to the work piece being bent as the work piece is advanced between the bending roller and the first and second guide rollers.

18 Claims, 11 Drawing Sheets

ROLL BENDER WITH WORK PIECE SUPPORT

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application is a non-provisional of U.S. patent application Ser. No. 63/065,172 filed Aug. 13, 2020 entitled ROLL BENDER WITH WORK PIECE SUPPORT, which is hereby incorporated by reference in its entireties.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to roll bender apparatuses for bending work pieces.

More particularly, the present disclosure relates to roll bender apparatus for bending working pieces such as long metal strips or angle irons into generally circular or arched shapes. Conventional roll bender devices include two guide rollers and a movable roller positioned between the guide rollers. An initially straight or slightly bent work piece can be positioned or clamped between the movable roller and the two guide rollers. One or more of the rollers can be driven either manually or via a motor to advance the work piece back and forth between the movable roller and the guide rollers. The position of the movable roller can be adjusted between successive passes of the work piece through the roll bender rollers to gradually increase the amount of bending in the work piece until the work piece reaches a desired shape or curvature.

One problem with conventional roll bender devices is that the work piece can be susceptible to twisting as it passes through the movable roller and/or beyond the guide rollers, which is undesirable. Some conventional roll bender devices can include one or more rollers or guides designed to help prevent twisting of the work piece. However, conventional anti-twisting rollers or guides are typically mounted to a base of the roll bender and must be adjusted between each pass of the work piece through the roll bender as the bend in the work piece changes. Manual adjustment of these anti twisting rollers can be cumbersome and time consuming. Additionally, one constraint of conventional anti-twisting guides or rollers on roll benders is that because these anti-twisting guides or rollers are mounted to the base in a fixed position as the work piece is passed through the roll bender, the anti-twisting rollers cannot be oriented in a position that would prevent the desired bending of the work piece. As such, conventional anti-twisting rollers or guides on roll benders can only resist twisting in a limited number of directions, such that twisting can still occur in the work piece.

What is needed then are improvements in roll bender devices.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the present disclosure is a roll bender apparatus for bending a work piece, the apparatus including a base. A bending roller can be rotatably disposed on the base. A first guide roller can be rotatably disposed on the base, and a second guide roller can be rotatably disposed on the base. The first and second guide rollers can be positioned on opposite sides of the bending roller. One or more of the bending roller and/or the first and second guide rollers can be translatable on the base to vary the bending or curvature produced in the work piece as the work piece is advanced through the bending roller and first and second guide rollers. One or more of the bending roller, the first guide roller, or the second guide roller can be drivable to advance the work piece when the work piece is positioned between the bending roller and the first and second guide rollers, the bending roller being translatable on the base to vary the bending of the work piece as the work piece is advanced between the bending roller and the first and second guide rollers. A first work piece guide assembly can be moveable about the first guide roller, and a second work piece guide assembly can be movable about the second guide roller. The first and second work piece guide assemblies can be oriented to receive the work piece as the work piece is advanced between the bending roller and the first and second guide rollers.

The first and second work piece guide assemblies can be configured to move about the first and second guide rollers respectively in response to the work piece being bent as the work piece is advanced between the bending roller and the first and second guide rollers, or the first and second work piece guide assemblies can be configured to move with the work piece as the work piece is bent by the apparatus. In some embodiments, the first and second work piece guide assemblies can be rotatable about the same axles on which the first and second guide rollers are disposed. The work piece guide assemblies can be movable during operation of the apparatus to conform to the changing curvature of the work piece and yet still resist twisting or deformation of the work piece.

The work piece guide assemblies being moveable with the work piece, rotatably disposed about the guide rollers, and/or in some embodiments on the same axles on which the guide rollers are disposed, can allow the work piece guide assemblies to move about their respective guide rollers to accommodate progressive bending of the work piece as the work piece is successively passed back and forth between the bending roller and the guide rollers. Because the work piece guide assemblies move about the corresponding guide rollers as the work piece bends, adjustment of the position of the work piece guide assemblies during operation of the apparatus without the user having to make manual adjustments between passes.

In some embodiments, the work piece guide assemblies can include two or more guide assembly rollers that can be oriented to engage multiple sides of the work piece as the work piece is received in the work piece guide assemblies to help resist twisting of the work piece as the work piece is being bent by the roll bender apparatus. In some embodiments, the guide assembly rollers can be adjustable on the work piece guide assemblies to accommodate work pieces of varying sizes and shapes, but during a bending process the work piece guide assemblies can move about the guide rollers to accommodate the gradual and progressive bending of the work piece in successive passes of the work piece through the bending roller apparatus.

Numerous other objects, advantages and features of the present disclosure will be readily apparent to those of skill in the art upon a review of the following drawings and description of a preferred embodiment.

DETAILED DESCRIPTION

Figure 1:
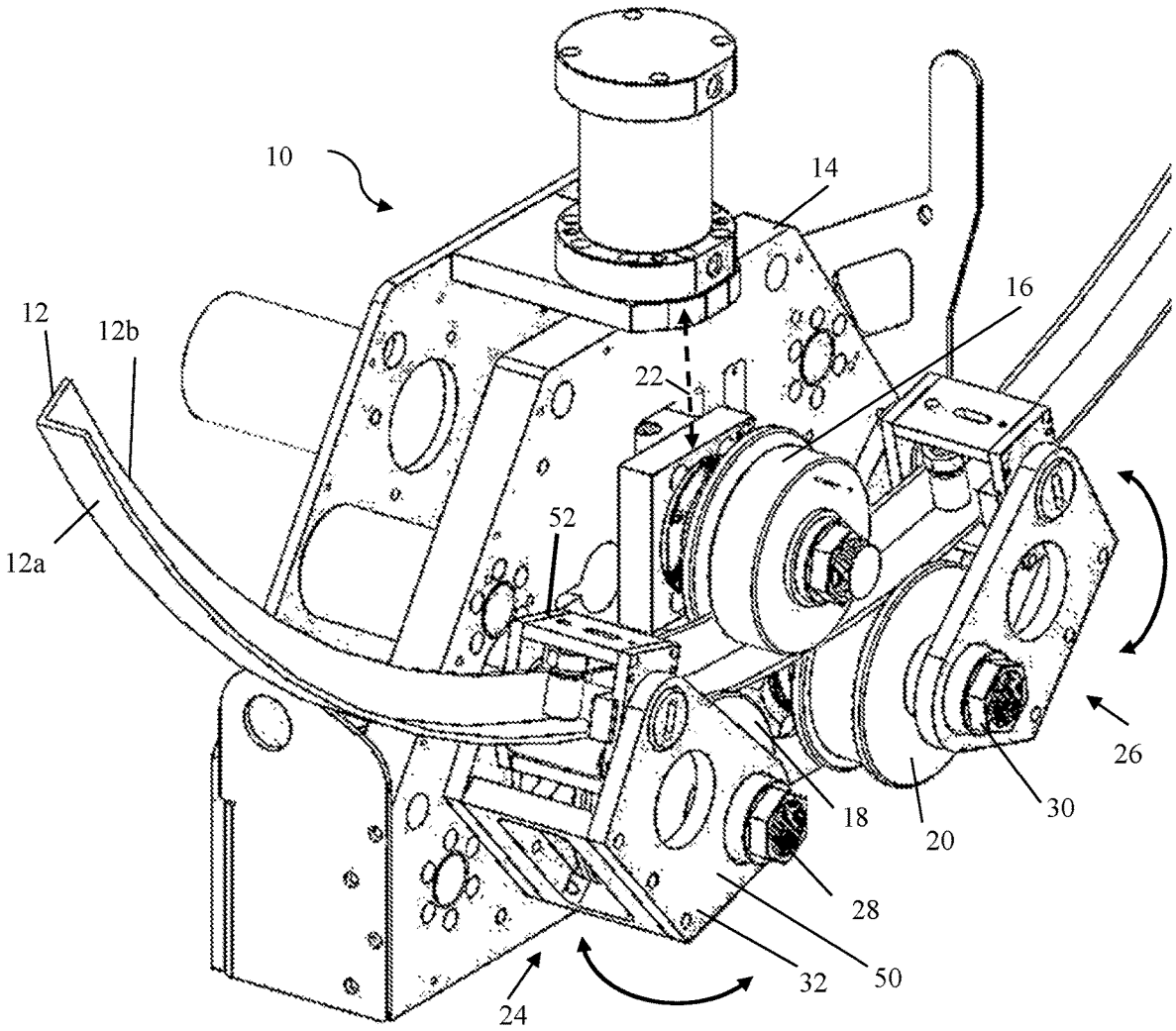
FIG. 1 is a right perspective view of one embodiment of a bending roller apparatus of the present disclosure.
Figure 2:
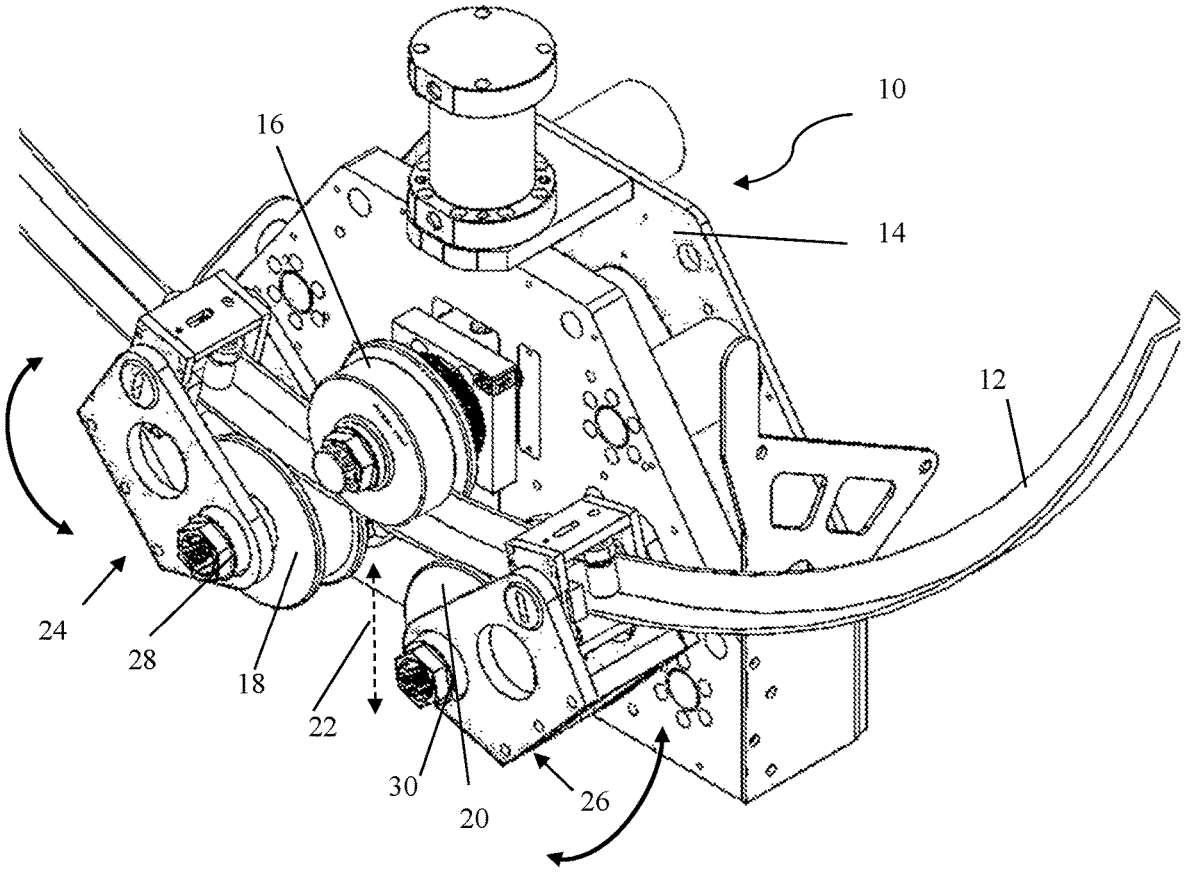
FIG. 2 is a left perspective view of the bending roller apparatus of FIG. 1.
Figure 3:
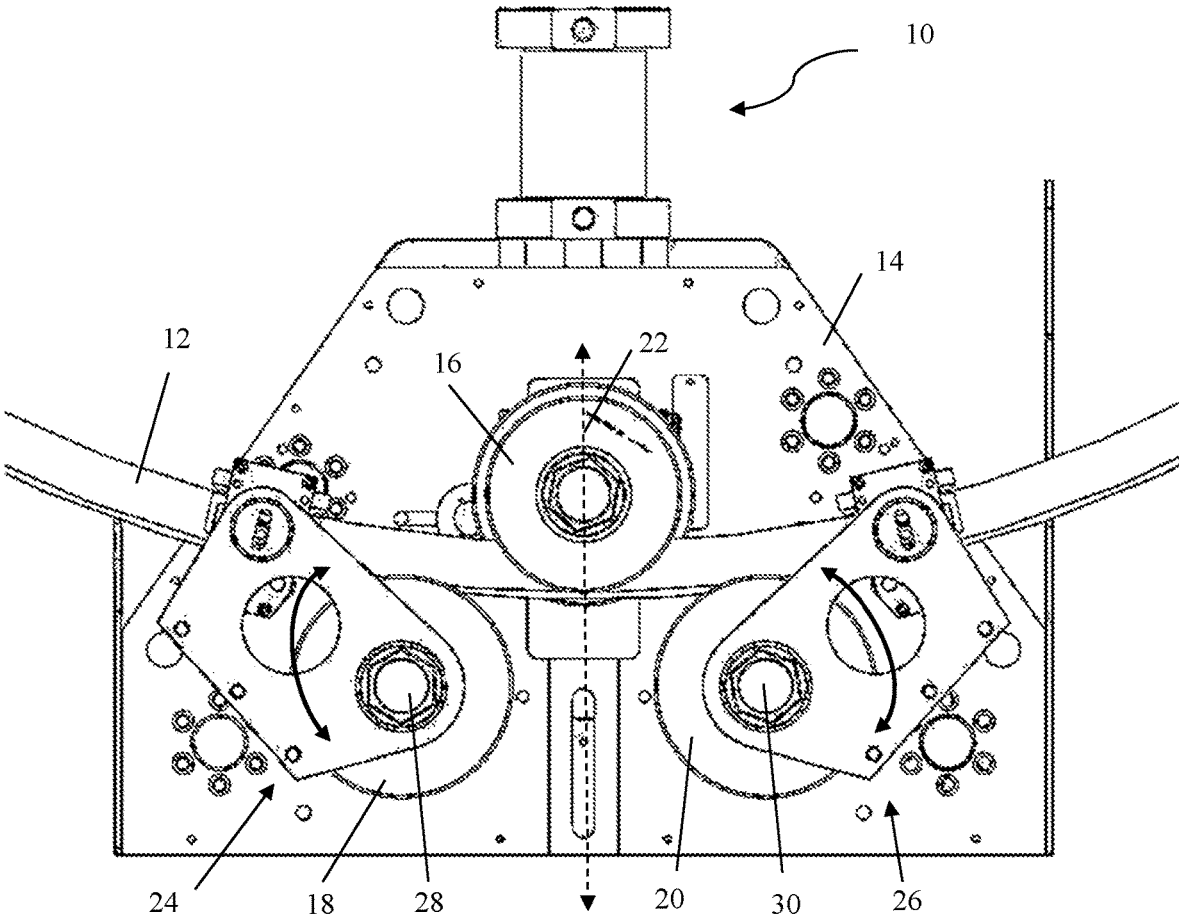
FIG. 3 is a front elevation view of the bending roller apparatus of FIG. 1.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

As shown in FIGS. 1-9, one aspect of the present disclosure is a roll bender apparatus 10 for bending a work piece 12, the apparatus 10 including a base 14. A bending roller 16 can be rotatably disposed on the base 14. A first guide roller 18 can be rotatably disposed on the base 14, and a second guide roller 20 can be rotatably disposed on the base 14. The first and second guide rollers 18 and 20 can be positioned on opposite sides of the bending roller 16. In some embodiments, the bending roller 16 can be translatable on the base 14 in a direction 22 extending between the first and second guide rollers 18 and 20, and the first and second guide rollers can be stationary or disposed in a fixed location on the base. In other embodiments, the bending roller 16 and the guide rollers 18 and 20 can be translatable on the base 14. One or more of the bending roller 16, the first guide roller 18, or the second guide roller 20 can be drivable to advance the work piece 12 when the work piece 12 is positioned between the bending roller 16 and the first and second guide rollers 18 and 20. In some embodiments, one or more of the bending roller 16 and/or guide rollers 18 and 20 can be driven manually, for instance via a crank shaft, or via a powered motor. In some embodiments, the manual or powered driving mechanism can be connected to a gear system which can drive each of the bending roller 16 and the first and second guide rollers 18 and 20 simultaneously.

In some embodiments, the bending roller 16 can be translatable on the base 14 to vary the bending of the work piece 12 as the work piece 12 is advanced between the bending roller 16 and the first and second guide rollers 18 and 20. A first work piece guide assembly 24 can be rotatably disposed about the first guide roller 18, and a second work piece guide assembly 26 can be rotatably disposed about the second guide roller 20. The first and second work piece guide assemblies 24 and 26 can be oriented to receive and resist twisting of the work piece 12 as the work piece 12 is advanced between the bending roller 16 and the first and second guide rollers 18 and 20.

Work pieces 12 can include long metal strips of material, including but not limited to metals such as steel, iron, and aluminum. The work pieces 12 can be repeatedly fed in a back and forth manner through the rollers 16, 18 and 20 of the apparatus 10 to cause the work pieces 12 to be progressively bent between passes. Work pieces 12 can be substantially flat plates, or the work pieces 12 can be angle irons or angled pieces including a first wall or work piece portion 12*a* and a second wall or work piece portion 12*b* that are oriented at an angle to one another. In some embodiments, the first and second walls 12*a* and 12*b* can be oriented substantially perpendicular to one another. As the work pieces 12 are fed through the rollers 16, 18, and 20, they can have a tendency to twist laterally with respect to a desired bending plane for the work piece 12.

The work piece 12 can be placed above the first and second guide rollers 18 and 20 and below the bending roller 16. The bending roller 16 and/or the guide rollers 18 and 20 can then be moved to clamp the work piece 12 between the bending roller 16 and the first and second guide rollers 18 and 20. The bending roller 16 can be further lowered to produce a localize bend in the work piece 12. As one or more of the rollers 16, 18 and 20 and driven, the work piece 12 is advanced or fed between the bending roller 16 from above and the guide rollers 16 and 18 from below such that a bend profile created via the position of the bending roller 16 can be formed in all or substantially all of the length of the work piece 12. Between successive passes of the work piece 12 back and forth between the rollers 16, 18, and 20, the bending roller 16 can be further moved downward incrementally to produce a further bend in the work piece 12 until a desired curvature or circular or arched shape is reached.

Having the work piece guide assemblies 24 and 26 movable about the guide rollers 16 and 18 respectively during operation of the apparatus 10, and rotatably disposed about the guide rollers 18 and 20, respectively, in some embodiments, can allow the work piece guide assemblies 24 and 26 to move or rotate about their respective guide rollers 18 and 20 to accommodate and conform to the progressive bending or curvature of the work piece 12 during a bending operation. As the work piece 12 undergoes progressive bending with subsequent passes through the apparatus 10, the increased bending of the work piece 12 received in the guide assemblies 24 and 26 can cause the guide assemblies 24 and 26 to move or rotate about their respective axles 28 and 30 due to forces acting on the guide assemblies 24 and 26 by the work piece 12. Adjustment of the guide assemblies 24 and 26 can thus be directly achieved by the progressive bending of the work piece 12, such that a user does not have to manually adjust the position of the work piece guide assemblies 24 and 26 after each pass. The work piece guide assemblies 24 and 26 simply move or rotate about the axles 28 and 30 with the changing bending profile of the work piece 12 to maintain a proper engagement between the work piece guide assemblies 24 and 26 and the work piece 12.

As shown in FIGS. 6-9, in some embodiments, the apparatus 10 can include a first axle 28 and a second axle 30 disposed on the base 14, the first guide roller 18 disposed on the first axle 28 and the second guide roller 20 disposed on the second axle 30. The first and second work piece guide assemblies 24 and 26 can be rotatably disposed on the first and second axles 28 and 30 respectively. As the work piece 12 is progressively bent, the work piece guide assemblies 24 and 26 can rotate about their respective axles 28 and 30 to accommodate the bending of the work piece 12 as the position of the bending roller 16 on the base 12 is adjusted and an increased curvature (smaller radius of curvature) is induced in the work piece 12. The work piece guide assemblies 24 and 26 can still maintain sufficient contact with the work piece 12 as they move or rotate on their respective axles 28 and 30 to help resist twisting of the work piece 12.

Figure 4:
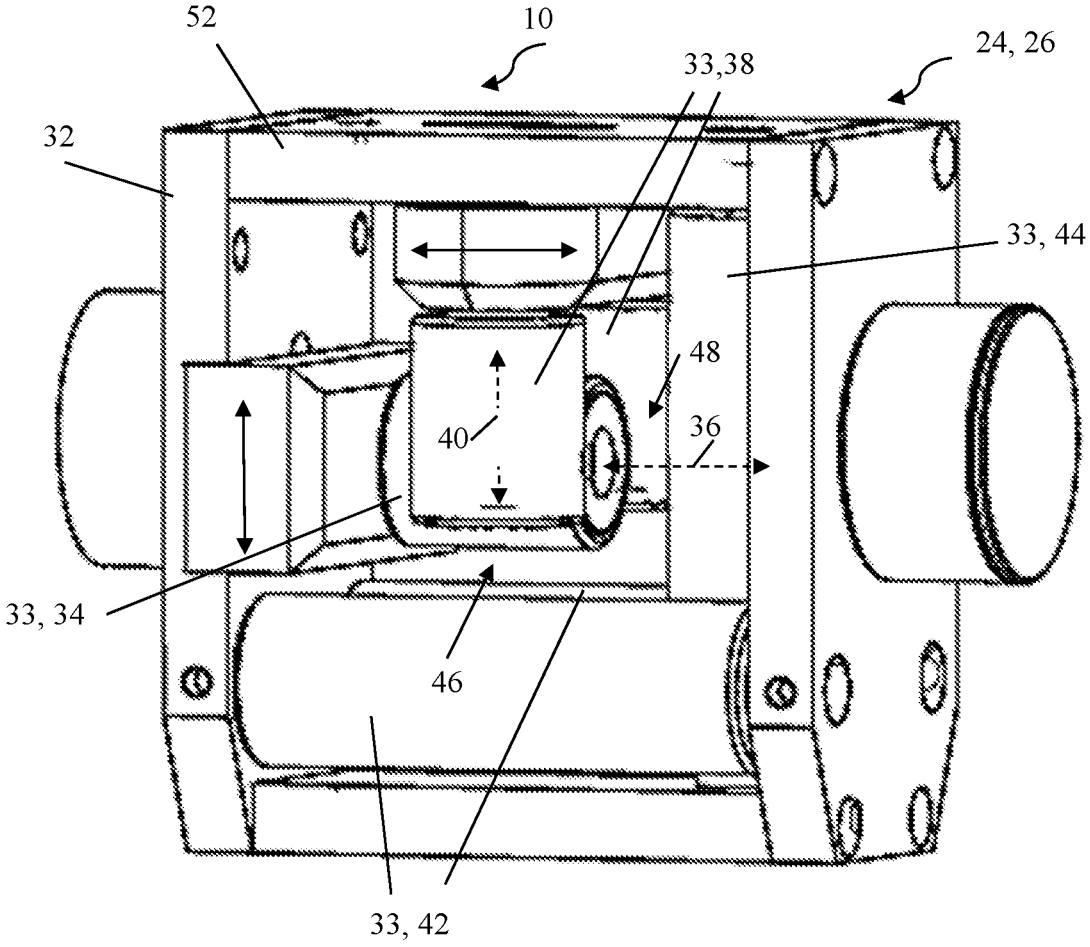
FIG. 4 is a perspective view of an embodiment of a work piece guide assembly of the present disclosure.
Figure 5:
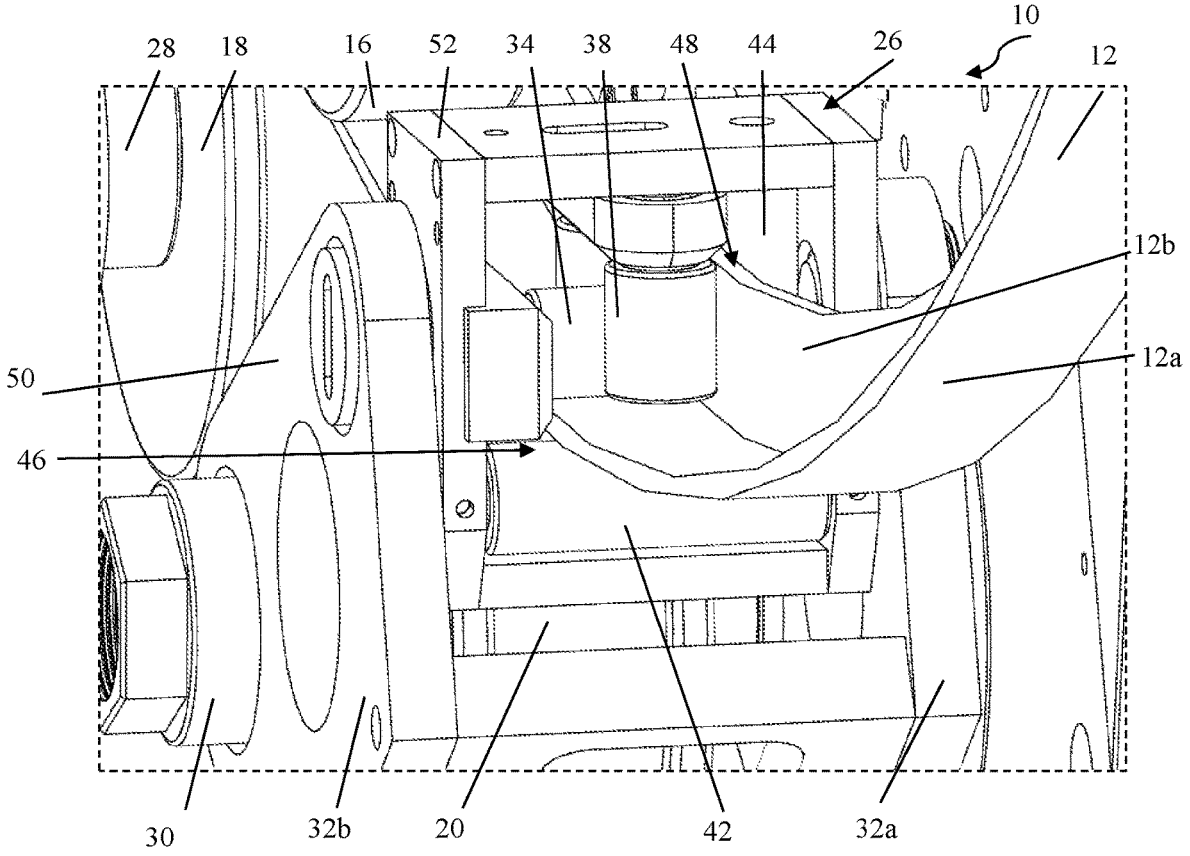
FIG. 5 is a detailed perspective view showing the engagement of guide assembly rollers of the work piece guide assembly of FIG. 4 with multiple sides and surfaces of a work piece.
Figure 6:
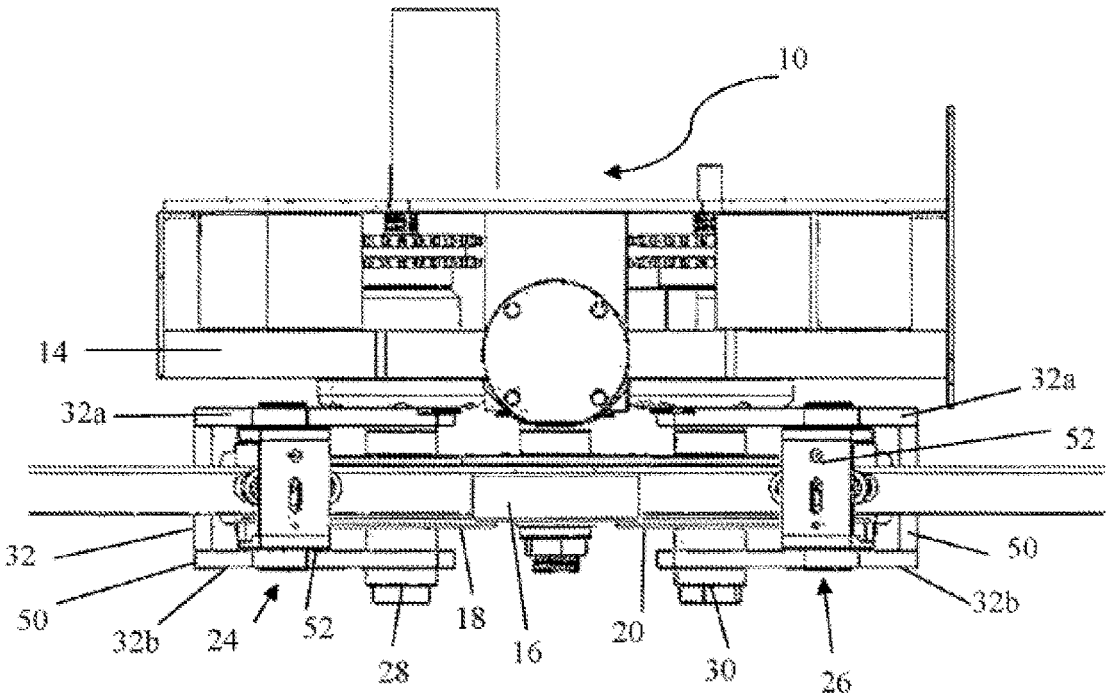
FIG. 6 is a top view of the apparatus of FIG. 1.
Figure 7:
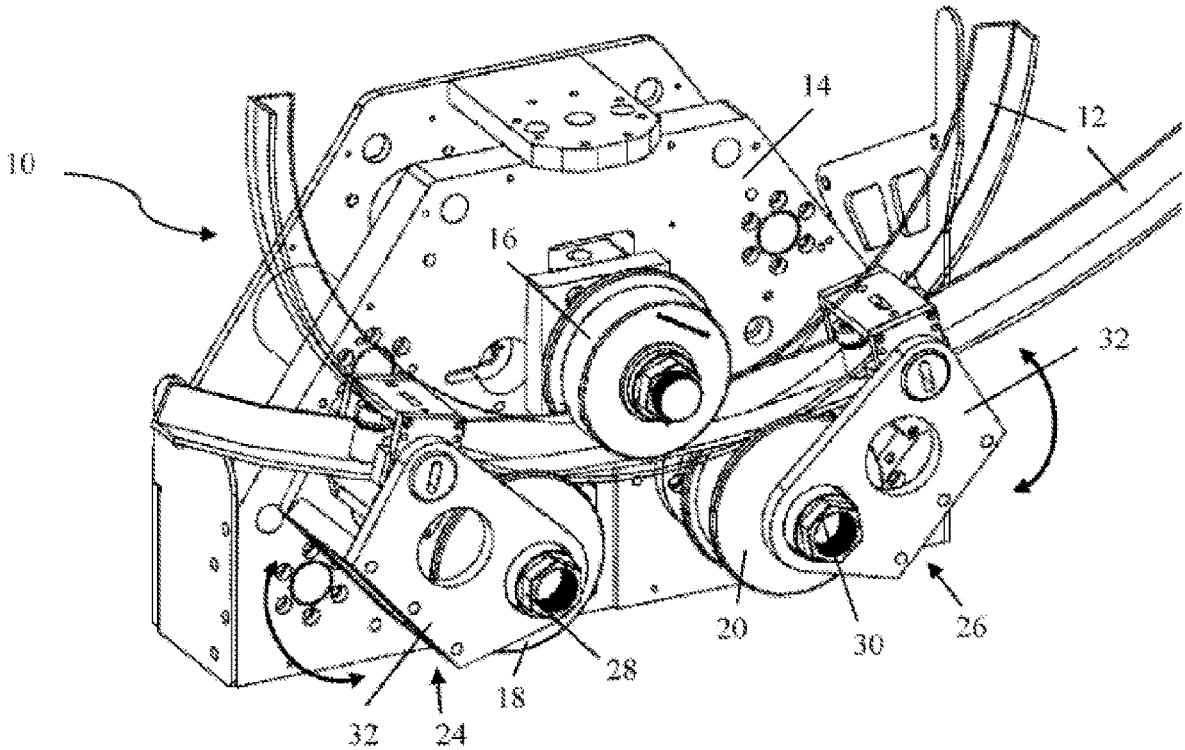
FIG. 7 is a detailed perspective view of the apparatus of FIG. 1 showing the desired curvature of the work piece to be bent by the apparatus.
Figure 8:
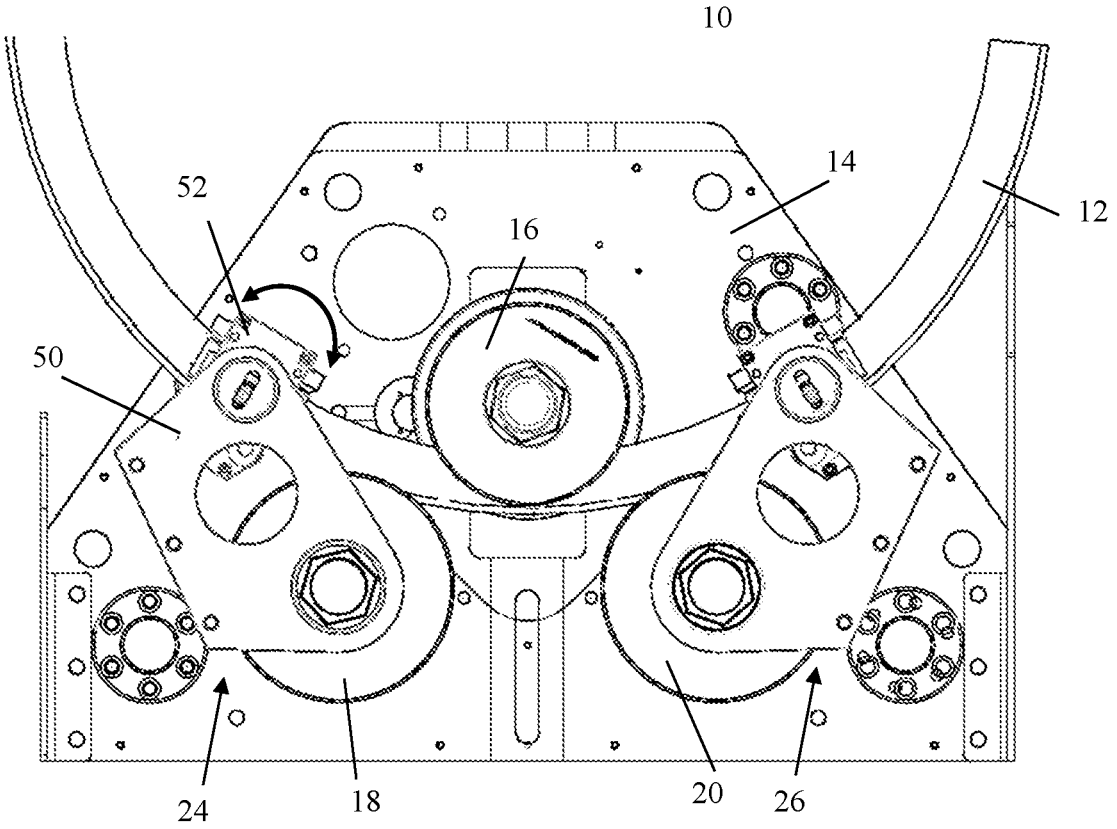
FIG. 8 is a front view of the apparatus of FIG. 1 showing the work piece bent to the desired curvature and the work piece guide assemblies moved to a second location relative to the base to conform to the curvature of the work piece.
Figure 9:
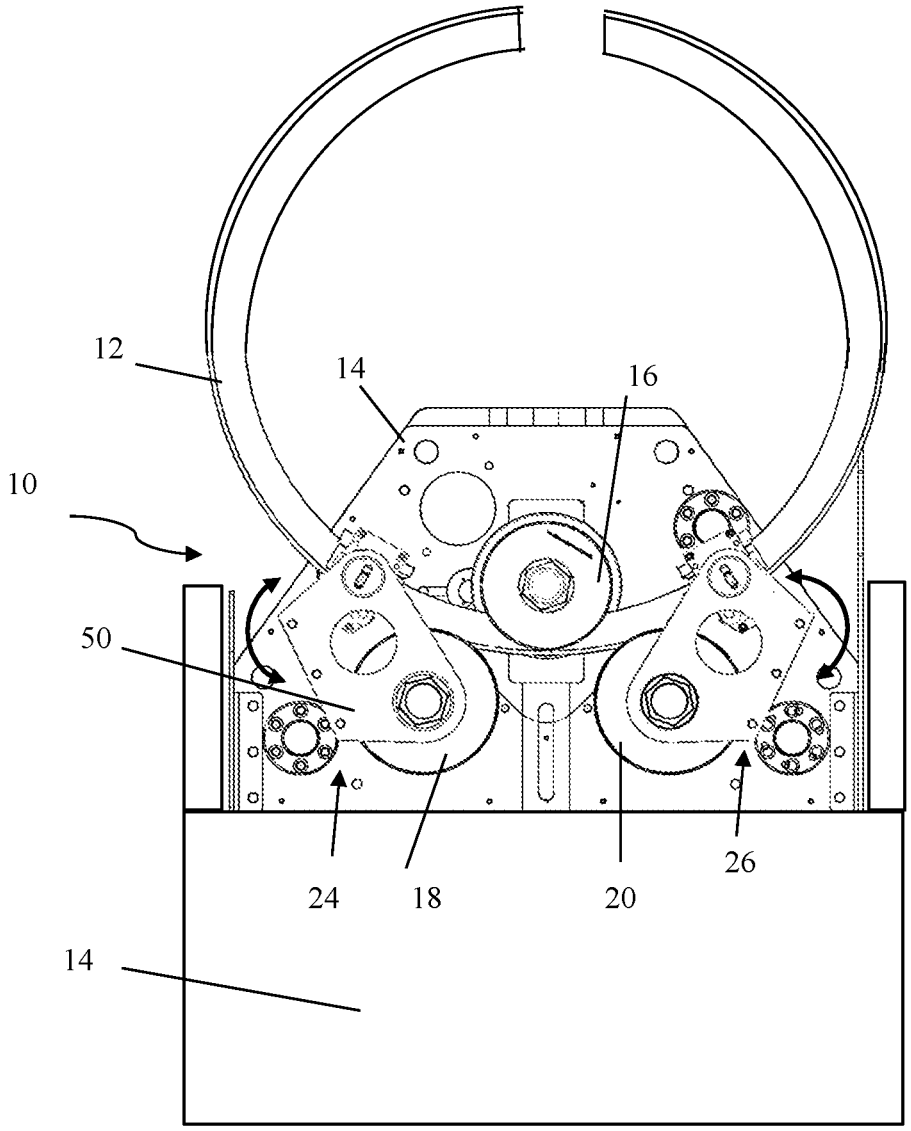
FIG. 9 is a front view of the apparatus of FIG. 1 on a larger base or base frame.

In some embodiments, as shown in FIGS. 4-6, each work piece guide assembly 24 and 26 can include a guide assembly frame 32 movably mounted on the base 14 and in some embodiments, rotatably mounted to the respective first or second axle 28 and 30. The guide assembly frame 32 can be rotatable or pivotable with respect to the base 14 to allow the angular orientation of the guide assembly frame 32, and thus the respective guide assembly 24 or 26 to vary to accommodate the work piece 12 as the curvature of the work piece 12 changes during a n bending operation. In some embodiments, the guide assembly frame 32 can include multiple frame members 32*a* and 32*b* pivotally connected to the respective axle 28 and 30 on opposite sides of the respective guide roller 18 or 20, which can provide stability for the work piece guide assemblies 24 and 26 about the respective guide rollers 18 and 20.

The work piece guide assemblies 24 and 26 can include one or more guide assembly rollers 33 that can be oriented to engage multiple sides or surfaces of the work piece 12 as the work piece 12 is received in the work piece guide assemblies 24 and 26 to help resist twisting of the work piece 12 as the work piece 12 is being bent by the roll bender apparatus 10. One or more of the guide assembly rollers 33 can be adjustable on the work piece guide assemblies 24 and 26 to accommodate work pieces 12 of varying sizes and shapes, but during a bending process the work piece guide assemblies 24 and 26 can rotate about the guide rollers 18 and 20 to accommodate the gradual and progressive bending of the work piece 12 in successive passes of the work piece 12 through the bending roller apparatus 10, and maintain a desired engagement of the rollers 33 with the work piece 12.

In some embodiments, a first guide assembly roller 34 can be rotatably disposed on the guide assembly frame 32 and have a first rotational axis 36 oriented in a first roller direction; and a second guide assembly roller 38 can be rotatably disposed on the guide assembly frame 32 having a second rotational axis 40 oriented in a second roller direction, the first and second roller directions oriented at an angle to one another. For angle irons especially that have a first side wall 12*a* and a second side wall 12*b*, having guide assembly rollers 34 and 38 oriented at angles to one another can allow the guide assembly rollers 38 and 40 to engage and apply pressure to either the first side wall 12*a* or the second side wall 12*b* of the angle iron work piece 12. In some embodiments, the first and second rotational axes 36 and 40 can be substantially perpendicular to one another. In other embodiments, the first and second rotational axis 36 and 40 can be oriented at any suitable angle relative to one another to accommodate and engage a desired shape of a work piece 12.

In some embodiments, the work piece guide assemblies 24 and 26 can include a third guide assembly roller 42 and a fourth guide assembly roller 44 rotatably disposed on the guide assembly frame 32. The third guide assembly roller 42 can be oriented generally parallel to the first guide assembly roller 34 and the fourth guide assembly roller 44 can be oriented generally parallel to the second guide assembly roller 38. A first gap or spacing 46 can be positioned between the first and third guide assembly rollers 34 and 42, and a second gap or spacing 48 can be positioned between the second and fourth guide assembly rollers 38 and 44. As can be seen in FIG. 5, when the work piece 12 is an angle iron, the first side wall 12*a* can be received in the first spacing 46 between the first and third guide assembly rollers 34 and 42, such that guide assembly rollers 34 and 42 engage opposing sides of the first side wall 12*a* of the angle iron work piece 12. Similarly, the second side wall 12*b* can be received in the second spacing 48 between the second and fourth guide assembly rollers 38 and 44, such that guide assembly rollers 38 and 44 engage opposing sides of the second side wall 12*b* of the angle iron work piece 12. Having guide assembly rollers 33 on both sides of the respective side portions or walls 12*a* and 12*b* of an angle iron work piece 12 can apply pressure against numerous surfaces of the angle iron as the angle iron is being fed through the bender apparatus 10 and the work piece guide assemblies 24 and 26, which can help resist twisting of both side walls 12*a* and 12*b* of the work piece 12 in multiple directions.

When flat work piece strips or plates are to be bent, the strips can be fed either between first and third guide rollers 34 and 42 or second and fourth guide assembly rollers 38 and 44 as desired to achieve the desired bending of the work piece 12 while applying pressure to multiple surfaces of the work piece 12 to help resist undesirable twisting during the bending process.

In some embodiments, as shown in FIG. 4, one or more of the guide assembly rollers 33 can be adjustable on the guide assembly frame 32. For instance, the first guide assembly roller 34 can be adjustable to move toward and away from third guide assembly roller 42. Second guide assembly roller 38 can also be adjustable on the guide assembly frame 32 to move toward and away from the fourth guide assembly roller 44. Movement of the first or second guide assembly rollers 34 or 38 can adjust the size of the first and second gaps or spacings 46 and 48 respectively. As such, guide assembly rollers 34 and 38 on the guide assemblies 24 and 26 can be adjustable to accommodate work pieces having different sizes, dimensions or thicknesses. While first and second guide assembly rollers 34 and 38 are shown as being adjustable and third and fourth guide assembly rollers 42 and 44 are in a fixed position, in other embodiments that configuration can be reversed. In still other embodiments, all four guide assembly rollers 34, 38, 42, and 44 can be adjustable on the guide assembly frame 32.

Figure 12:
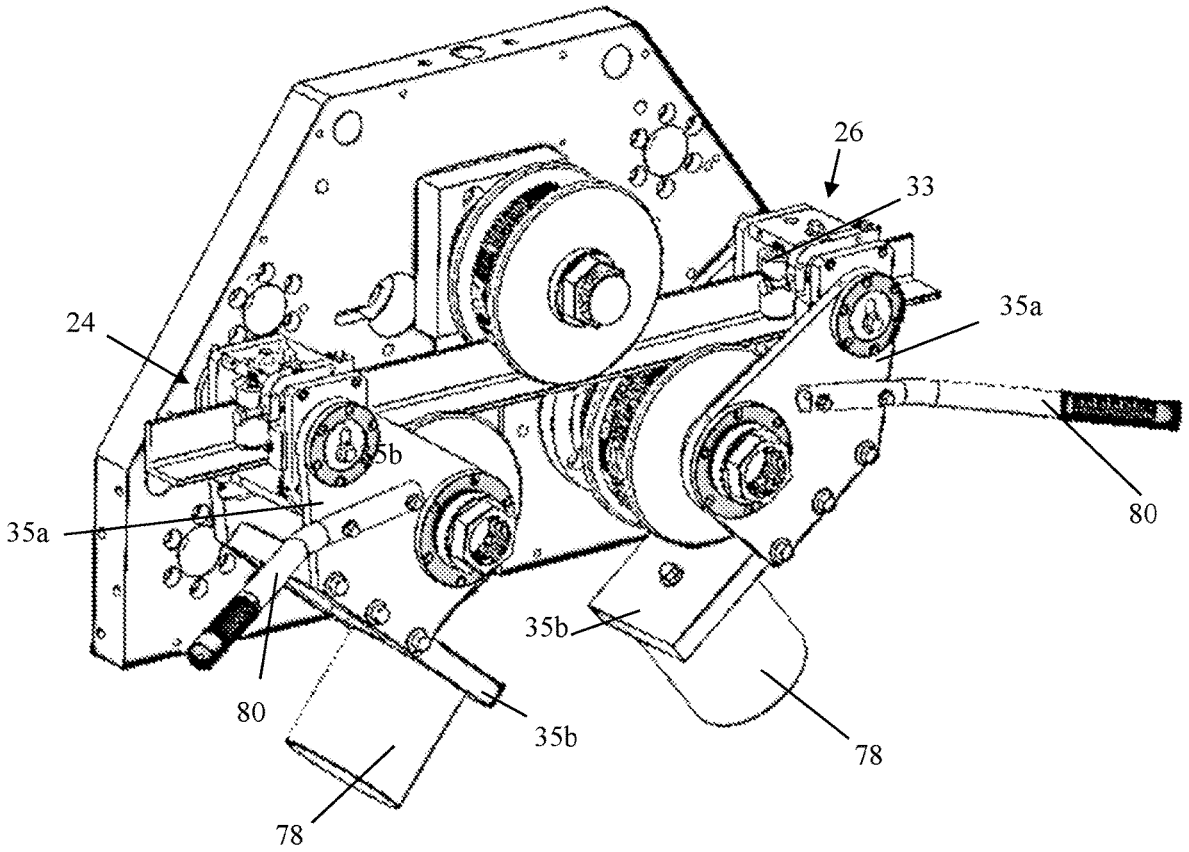
FIG. 12 is a perspective view of another embodiment of a bending roller apparatus of the present disclosure including handles and counterweights on the work piece guide assemblies to ease in movement of the work piece guide assemblies when a work piece is being inserted or removed from the apparatus.
Figure 13:
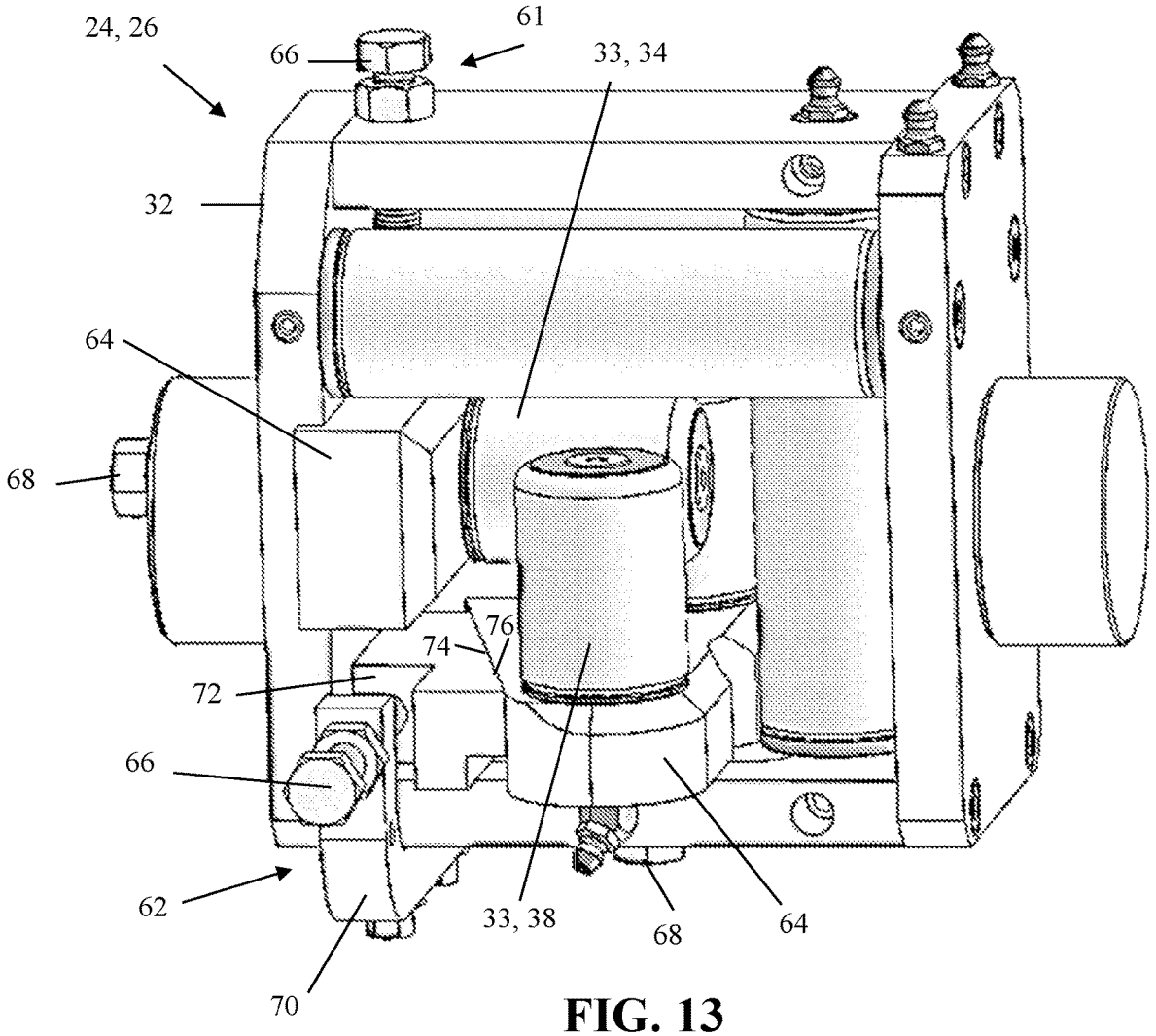
FIG. 13 is a detailed perspective view of another embodiment of a work piece guide assembly of the present disclosure showing adjustment devices on the guide assemblies for at least one guide assembly roller.

In some embodiments, as shown in FIGS. 12-13, the guide assemblies 24 and 26 can have one or more roller adjustment assemblies 61 and 62 disposed on the guide assembly frame 32 which can be operable to adjust the position of a corresponding guide assembly roller 33. For instance, in some embodiments, each of the guide assemblies 24 and 26 can include a first roller adjustment assembly 61 operable to adjust the position of a first guide assembly roller 34 and a second roller adjustment assembly 62 operable to adjust the position of a second guide assembly roller 38. In some embodiments, the roller adjustment assemblies 61 and 62 can each include an adjustment bolt 66 that can engage a roller mount 64 onto which the corresponding roller 34 or 38 is mounted. The adjustment bolts 66 can be advanced to push the roller mount 64 to a desired position to adjust the spacings between pairs of parallel guide assembly rollers on the guide assemblies 24 and 26. The adjustment bolts 66 can be retracted and the roller mount 64 can be manually pushed against the adjustment bolt 66 to move the roller mount 64 in an opposite direction. Retention bolt 68 can be coupled to corresponding roller mounts 64 to secure and retain the corresponding roller mount 64, and thus the corresponding guide assembly roller 34 or 38, in a desired position.

In some embodiments, the adjustment bolt 66 for a particular roller adjustment assembly can be threadingly engaged with the guide assembly frame 32, as shown for the adjustment bolt 66 in the first roller adjustment assembly 61 in FIG. 13. In still other embodiments, one or more of the roller adjustment assemblies 61 and 62 can include a wedging mechanism which can allow an adjustment bolt 66 to be driven in a more accessible direction for the user, while achieving the desired direction of movement of the particular guide assembly roller 34 or 38. For instance, in the second roller adjustment mechanism 62 shown in FIG. 13, the second guide assembly roller 38 is adjustable in a lateral, or left and right direction with respect to the orientation shown in FIG. 13. The second roller adjustment assembly 62 includes a driving bolt bracket 70 secured to the guide assembly frame 32. The adjustment bolt 66 is threadingly engaged with the driving bolt bracket 70 and can be advanced to engaged a wedge driver member 72. The wedge driver member 72 can include an angled surface 74 which can engage a complementary angled surface 76 on the roller mount 64 for the second guide assembly roller 38. As the driving bolt 66 advances, the wedge driver member 72 forces the roller mount 64 of the second roller adjustment in the desired direction at an angle with respect to the driving direction of the adjustment bolt 66. While several embodiments of roller adjustment assemblies have been described herein, any suitable roller adjustment mechanism or assembly for adjusting the position of one or more of the guide assembly rollers 33 on the guide assemblies 24 and 26 can be utilized.

In still other embodiments, one or more of first, second, third, or fourth guide assembly rollers 34, 38, 42, and 44 can include pairs of guide assembly rollers aligned to engage the same surface of the work piece 12. As such, multiple points of engagement on one or more surfaces of the work piece 12 can be provided by the work piece guide assemblies 24 and 26.

In some embodiments, the guide assembly frame 32 can include an axle engagement portion 50 and guide assembly roller engagement portion 52. The axle engagement portion 50 can be rotatably disposed on the respective axles 28 and 30, and the guide assembly roller engagement portion 52 can house the various guide assembly rollers 34, 38, 42, or 44, which can be rotatably disposed on the guide assembly roller engagement portion 52. In some embodiments, the guide assembly roller engagement portion 52 can be pivotable on the axle engagement portion 50 such that as the work piece 12 is being progressively bent by the apparatus 10, the guide assemblies 24 and 26 can pivot about their respective axles 28 and 30, and the guide roller engagement portion 52 can independently pivot relative to the axle engagement portion 50 to better or optimally align the guide assembly rollers 34, 38, 42, and 44 with the various desired surfaces of the work piece 12.

In some embodiments, as shown in FIG. 12, each of the guide assembly frame 32 can further include a first end 35*a* and a second end 35*b*. The guide assembly rollers 33, 34, 38, 42 and/or 44 can be positioned on the first end 35*a* of the guide assembly frame 32, and each of the guide assemblies 24 and 26 further include a counterweight 78 positioned on the second end 35*b* of the guide assembly frame 32. The guide assembly frame 32, guide assembly frame rollers 33 and their related components can be rather heavy such that manipulation and alignment of the guide assemblies 24 and 26 during loading of the work piece 12 on the apparatus 10 can be cumbersome, as the guide assemblies 24 and 26 would tend to pivot or move downward due to their weight. In particular for those embodiments where the guide assemblies are mounted on the axles 28 and 30 of the guide rollers, having a counterweight 78 on the opposing end of the guide assembly frame 32 from the guide assembly rollers 33 can help balance the weight of the guide assemblies 24 and 26 and maintain the guide assembly rollers in a position above the respective guide rollers 18 and 20 to make inserting or loading the work piece 12 through the guide assemblies 24 and 26 easier.

In some embodiments, each of the first and second guide assemblies can include an elongated handle 80 extending from the guide assembly frame 32. In some embodiments, the handles 80 can extend from either the first or second ends 35*a* or 35*b* of the guide assembly frame 32. The handles 80 can help the user manipulate the guide assemblies 24 and 26 during loading of installation of the work piece 12 on the apparatus 10.

In some embodiments, at least one motor can be operable to drive one or more of the bending roller 16, the first guide roller 18, or the second guide roller 20 to advance the work piece 12 when the work piece 12 is positioned between the bending roller 16 and the first and second guide rollers 18 and 20. In some embodiments, a single motor can drive one of the bending roller 16, first guide roller 18, or second guide roller 20, and the non-driven rollers can simply rotate due to the movement or advancement of the work piece 12. In some embodiments, a single motor can be operable to drive the bending roller 16 and guide rollers 18 and 20, or their respective axles, simultaneously and at the same speed. A gear system can be coupled between the bending roller 16 and first and second guide rollers 18 and 20. A single motor can be coupled to and drive one of the bending roller 16 or guide rollers 18 and 20 or their respective axles directly, and the gear system can simultaneously cause the other rollers to be driven, such that the work piece 12 can be advanced via three separate drive forces from each of the bending roller 16, the first guide roller 18, and the second guide roller 20. In other embodiments, each of the bending roller 16, the first guide roller 18, and the second guide roller 20 can be coupled to independent motors, and the motors can be run simultaneously at the same speed or at different speeds such that the linear velocity of the rollers at the point of contact with the work piece 12 is the same. In some embodiments, translation of the bending roller 16 and/or the guide rollers 18 and 20 on the base 14 can also be achieved by a motor or other automated means.

Figure 10:
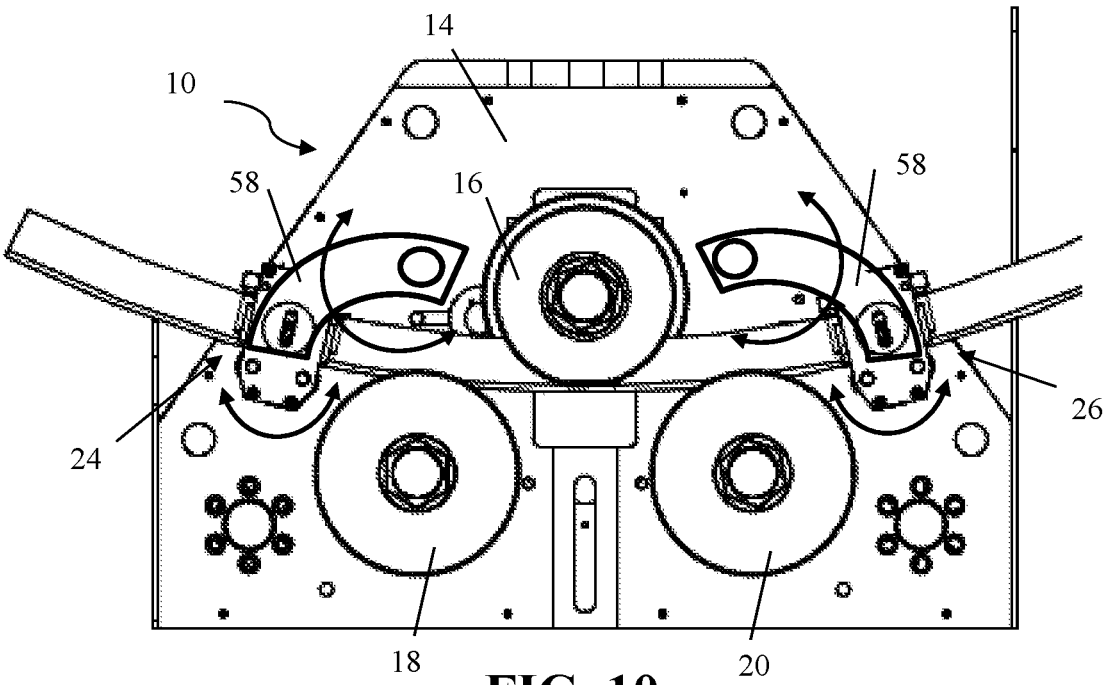
FIG. 10 is a front view of another embodiment of a bending roller apparatus of the present disclosure wherein each of the work piece guide assemblies are rotatably connected to the base via pivoting arm.

In some embodiments, as shown in FIG. 10, the first and second guide assemblies 24 and 26 can be mounted to the base 14 and configured such that the first and second guide assemblies 24 and 26 are movable about the first and second guide rollers 18 and 20 respectively. In some embodiments, first and second guide assemblies 24 and 26 can be mounted to distal ends of pivoting arms 58 that can be rotatably connected to the base 14. As a work piece received in the first and second guide assemblies 24 and 26 is progressively bent, the bending of the work piece can cause the work piece guide assemblies 24 and 26 to rotate on the base 14 and about the guide rollers 18 and 20 via the pivoting arms 58. As such the work piece guide assemblies 24 and 26 can be movable or rotatable about the guide rollers 18 and 20 top move with work piece as the work piece is bent. In some embodiments, the work piece guide assemblies 24 and 26 can be rotatable on the distal ends of the pivoting arms 58 such that the work piece guide assemblies 24 and 26 can move with the pivoting arms 58 but can also rotate on the pivoting arms 58 to accommodate different positions and orientations of the work piece during a bending procedure.

Figure 11:
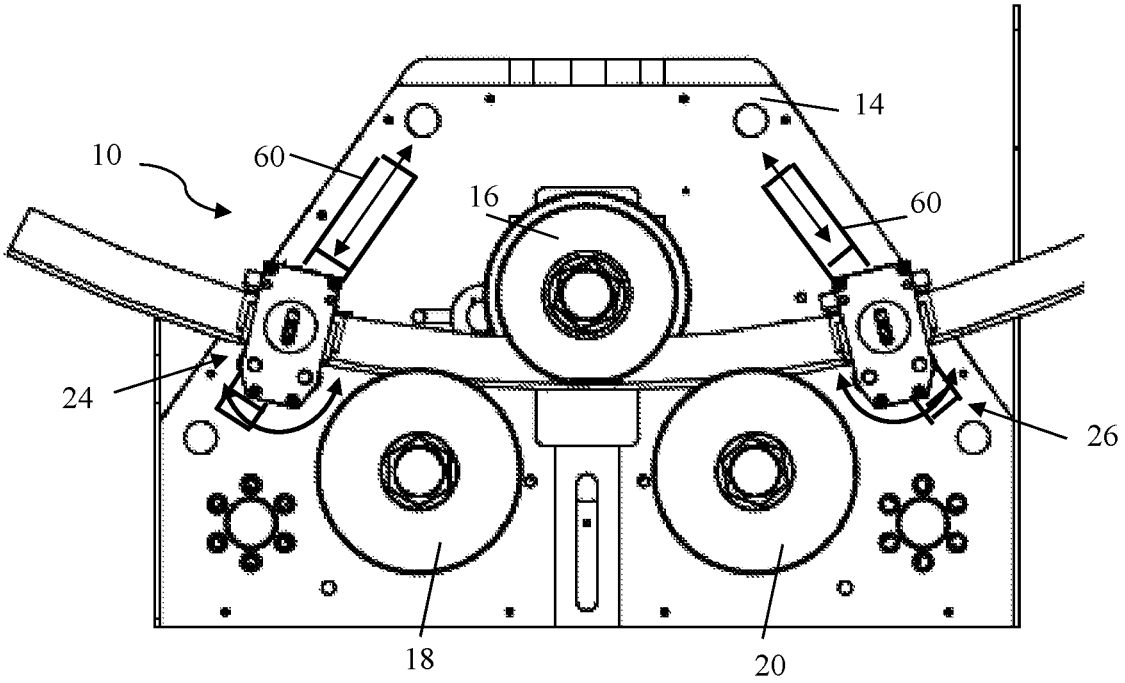
FIG. 11 is a front view of another embodiment of a bending roller apparatus of the present disclosure wherein each of the work piece guide assemblies are movable on the base via a linear track and slide movable within the linear track.

In some embodiments, as shown in FIG. 11, the base 12 can include tracks 60 positioned above respective guide rollers 18 and 20. Work piece guide assemblies 24 and 26 can be slidable within the tracks 60 such that as the work piece is bent during a bending operation, the work piece guide assemblies 24 and 26 can slide within the tracks 20 to accommodate bending of the work piece. In some embodiments the tracks 60 can be angled linear tracks, while in other embodiments the tracks 60 can be curved, to approximate the desired movement of the work piece guide assemblies 24 and 26 as the work piece is progressively bent. In some embodiments the work piece guide assemblies 24 and 26 can be rotatable within the tracks 60 so that the work piece guide assemblies 24 and 26 can both move in the tracks 60 and rotate to accommodate bending of the work piece.

Thus, although there have been described particular embodiments of the present invention of a new and useful ROLL BENDER WITH WORK PIECE SUPPORT, it is not intended that such references be construed as limitations upon the scope of this invention.

What is claimed is:

1. A roll bender apparatus for bending a work piece, the apparatus comprising:

a base;

a bending roller rotatably disposed on the base;

a first guide roller rotatably disposed on base;

a second guide roller rotatably disposed on the base, the first and second guide rollers positioned on opposite sides of the bending roller, wherein one or more of the bending roller, the first guide roller, and/or the second guide roller is translatable on the base to vary the bending of the work piece as the work piece is advanced between the bending roller and the first and second guide rollers;

a first work piece guide assembly movable about the first guide roller; and a second work piece guide assembly movable about the second guide roller;

wherein the first and second work piece guide assemblies are oriented to receive the work piece as the work piece is advanced between the bending roller and the first and second guide rollers, the first and second work piece guide assemblies configured to move about the first and second guide rollers respectively in response to the work piece being bent as the work piece is advanced between the bending roller and the first and second guide rollers; and wherein each work piece guide assemblies further comprises a guide assembly frame rotatable relative to the base, a first guide assembly roller rotatably disposed on the guide assembly frame and having a first rotational axis oriented in a first roller direction, and a second guide assembly roller rotatably disposed on the guide assembly frame and having a second rotational axis oriented in a second roller direction oriented at an angle to the first roller direction.

2. The apparatus of claim 1, wherein one or more of the bending roller, the first guide roller, or the second guide roller is drivable to advance the work piece when the work piece is positioned between the bending roller and the first and second guide rollers.

3. The apparatus of claim 1, wherein each of the first and second work piece guide assemblies is oriented to resist twisting of the work piece when the work piece is positioned within the work piece guide assemblies as the work piece is advanced through the bending roller and the first and second guide rollers.

4. The apparatus of claim 1, further comprising:

a first axle and a second axle disposed on the base;

wherein the first guide roller is disposed on the first axle and the second guide roller is disposed on the second axle; and wherein the first and second work piece guide assemblies are rotatably disposed on the first and second axles respectively to accommodate bending of the work piece as the position of the bending roller on the base is adjusted and the work piece is advanced through the bending roller and the first and second guide rollers.

5. The apparatus of claim 1, wherein each of the first and second work piece guide assemblies further comprises:

a third guide assembly roller disposed on the guide assembly frame and having a third rotational axis oriented in a third roller direction that is parallel to the first roller direction; and a fourth guide assembly roller disposed on the guide assembly frame and having a fourth rotational axis oriented in a fourth roller direction that is parallel to the second roller direction.

6. The apparatus of claim 5, wherein the work piece includes a first work piece portion and a second work piece portion oriented at an angle to the first work piece portion, and the apparatus further comprises:

a first work piece gap defined between the first and third guide assembly rollers for receiving the first portion of the work piece; and a second work piece gap defined between the second and fourth guide assembly rollers for receiving the second portion of the work piece.

7. The apparatus of claim 5, wherein the first and second guide roller assemblies are adjustable on the guide assembly frame.

8. The apparatus of claim 7, wherein each guide roller assembly further comprises:

a first roller adjustment assembly operable to adjust the position of the first guide assembly roller; and a second roller adjustment assembly operable to adjust the position of the second guide assembly roller.

9. The apparatus of claim 8, wherein one of the first or second guide assembly rollers is rotatably disposed on a roller mount movable on the guide assembly frame, the roller mount having an angled surface, and the correspond first or second first roller adjustment device includes a wedge driver member engageable with the angled surface of the roller mount and advanceable to move the roller mount, and thus the first or second guide assembly roller, on the guide assembly frame.

10. The apparatus of claim 1, further comprising:

a first elongated handle extending from the first work piece guide assembly; and a second elongated handle extending from the second work piece guide assembly.

11. A roll bender apparatus for bending a work piece, the apparatus comprising:

a base;

a bending roller rotatably disposed on the base;

a first guide roller rotatably disposed on base;

a second guide roller rotatably disposed on the base, the first and second guide rollers positioned on opposite sides of the bending roller, wherein the bending roller is translatable on the base in a direction extending between the first and second guide rollers, and one or more of the bending roller, the first guide roller, or the second guide roller is drivable to advance the work piece when the work piece is positioned between the bending roller and the first and second guide rollers, the bending roller being adjustable on the base to vary the bending of the work piece as the work piece is advanced between the bending roller and the first and second guide rollers;

a first work piece guide assembly rotatably disposed about the first guide roller; and a second work piece guide assembly rotatably disposed about the second guide roller;

wherein the first and second work piece guide assemblies are oriented to receive the work piece and resist twisting of the work piece as the work piece is advanced between the bending roller and the first and second guide rollers, and wherein each work piece guide assemblies further comprises a guide assembly frame rotatably mounted to the respective first or second axle, a first guide assembly roller rotatably disposed on the guide assembly frame and having a first rotational axis oriented in a first roller direction, and a second guide assembly roller rotatably disposed on the guide assembly frame and having a second rotational axis oriented in a second roller direction oriented at an angle to the first roller direction.

12. The apparatus of apparatus of claim 11, further comprising:

a first axle and a second axle disposed on the base, the first guide roller disposed on the first axle and the second guide roller disposed on the second axle;

wherein the first and second work piece guide assemblies are rotatably disposed on the first and second axles respectively to accommodate bending of the work piece as the position of the bending roller on the base is adjusted.

13. The apparatus of claim 11, wherein the first and second guide assembly rollers are adjustable on the guide assembly frame.

14. The apparatus of claim 11, wherein each guide assembly frame further comprises a first frame member and a second frame member, the first and second frame members rotatably disposed on the corresponding axle on opposite sides of the corresponding guide roller.

15. The apparatus of claim 11, wherein the guide assembly frame further includes a first end and a second end, the first and second guide assembly rollers positioned on the first end of the guide assembly frame, and the guide assembly further comprises a counterweight positioned on the second end of the guide assembly frame.

16. The apparatus of claim 11, further comprising at least one motor operable to drive one or more of the bending roller, the first guide roller, or the second guide roller to advance the work piece when the work piece is positioned between the bending roller and the first and second guide rollers.

17. A roll bender apparatus for producing a curvature in a work piece, the apparatus comprising:

a base;

a first stationary guide roller and a second stationary guide roller, the first and second stationary guide rollers rotatable on the base;

a bending roller, the bending roller movable on the base along a line of motion extending between the first guide roller and the second guide roller;

a first guide assembly positioned adjacent to the first guide roller; and a second guide assembly positioned adjacent to the second guide roller;

wherein each guide assembly is shaped to receive the work piece through the guide assembly and is movable about the corresponding guide roller to conform to changes in the curvature of the work piece as the work piece is bent during operation of the roll bender apparatus; and wherein each of the guide assemblies further comprises, a guide assembly frame movable about the corresponding guide roller, the guide assembly frame having a first end and second end, a first guide assembly roller rotatably disposed on the first end of the guide assembly frame and having a first rotational axis oriented in a first roller direction, a second guide assembly roller rotatably disposed on the guide assembly frame and having a second rotational axis oriented in a second roller direction oriented at an angle to the first roller direction.

18. The apparatus of claim 17, wherein each of the guide assemblies further comprises:

a handle extending from the first end of the guide frame assembly; and a counterweight positioned on a second end of the guide frame assembly.

* * * * *